US005116289A

United States Patent [19]

Pond et al.

[11] Patent Number: 5,116,289

[45] Date of Patent: May 26, 1992

[54] CARRY-ON CASE HAVING WHEELS AND AN EXTENDABLE HANDLE

[75] Inventors: Cecil E. Pond, Palm City, Fla.; Gary E. Pond, South Bend, Ind.

[73] Assignee: Porter Case, Inc., South Bend, Ind.

[21] Appl. No.: 676,716

[22] Filed: Mar. 29, 1991

[51] Int. Cl.[5] ..... A45C 5/14; A45C 9/00; A45C 13/26

[52] U.S. Cl. ..... 190/18 A; 190/115; 280/37; 280/655.1

[58] Field of Search ..... 190/18 A, 39, 115; 280/37, 47.17, 47.315, 655.1

[56] References Cited

U.S. PATENT DOCUMENTS

| | | | |
|---|---|---|---|
| 3,498,629 | 3/1970 | Richards | 280/47.315 |
| 3,522,955 | 8/1970 | Warner, Jr. | 190/18 A X |
| 3,917,038 | 11/1975 | Foge et al. | 190/18 A |
| 3,960,252 | 6/1976 | Cassimally | 190/18 A |
| 3,997,038 | 12/1976 | Walker | 190/18 A |
| 4,273,222 | 6/1981 | Cassimally et al. | 190/18 A |
| 4,314,624 | 2/1982 | Royet | 190/18 A |
| 4,358,005 | 11/1982 | Fontana | 190/115 X |
| 4,411,343 | 10/1983 | Cassimally et al. | 190/18 A |
| 4,637,626 | 1/1987 | Foss et al. | 280/655.1 X |
| 4,890,705 | 1/1990 | Pineda | 190/18 A |

FOREIGN PATENT DOCUMENTS

| | | | |
|---|---|---|---|
| 2598897 | 11/1987 | France | 190/18 A |
| 2124589 | 2/1984 | United Kingdom | 190/18 A |
| 2135638 | 9/1984 | United Kingdom | 189/18 A |
| 2197637 | 5/1988 | United Kingdom | 190/18 A |

*Primary Examiner*—Sue A. Weaver
*Attorney, Agent, or Firm*—James D. Hall

[57] ABSTRACT

An improved carry-on case having a built-in travel cart capable of being towed by itself or with several pieces of luggage. The handle of the cart can be retracted for convenient storage.

5 Claims, 6 Drawing Sheets

CARRY-ON CASE HAVING WHEELS AND AN EXTENDABLE HANDLE

FIELD OF THE INVENTION

This invention relates to a carry-on case and has specific but not limited application to a durable lightweight carry-on case having an improved built-in wheel and handle assembly for portable travel convenience.

BACKGROUND OF THE INVENTION

The conventional carry-on case is typically a hand-carried travel case. Such cases are usually carried by a handle. It is generally necessary that this type of case be carried throughout an airport from places of departure to airplanes, from airplanes to airplanes, and from airplanes to places of arrival. For such cases there is provided a wheeled frame which is separately carried in addition to the carry-on case. The frame serves as a cart onto which the case can be strapped for transport. There are also cases that include incorporated handles and wheels so that the cases can be pulled by the handles, thereby permitting them to be towed about and transported throughout the airport. A problem with these prior art carry-on cases exists in that it is impractical, if not impossible, to use these cases as a support upon which to stack additional pieces of luggage without special devices or attachment hooks.

The present invention overcomes the above stated deficiencies of the prior art.

Summary of the Invention

The carry-on case of this invention serves to alleviate the problem and inconvenience of transporting cumbersome luggage cases. This case contains a storable built-in handle which can function as a luggage travel cart by which the case can be pulled. This case can also be used to carry additional pieces of luggage stacked on top of the case, thereby permitting such pieces of luggage to be transported at one time.

It is therefore an object of this invention to provide for a novel carry-on case.

Another object of this invention is to provide for a case with wheels and a built-in handle functioning as a travel cart.

Another object of this invention is to provide for a case with wheels and a built-in collapsible handle that can be used to carry stacked luggage.

Other objects of the invention will become apparent upon a reading of the following description taken with the accompanying drawings.

DESCRIPTION OF THE PREFERRED EMBODIMENT

Figure 1:
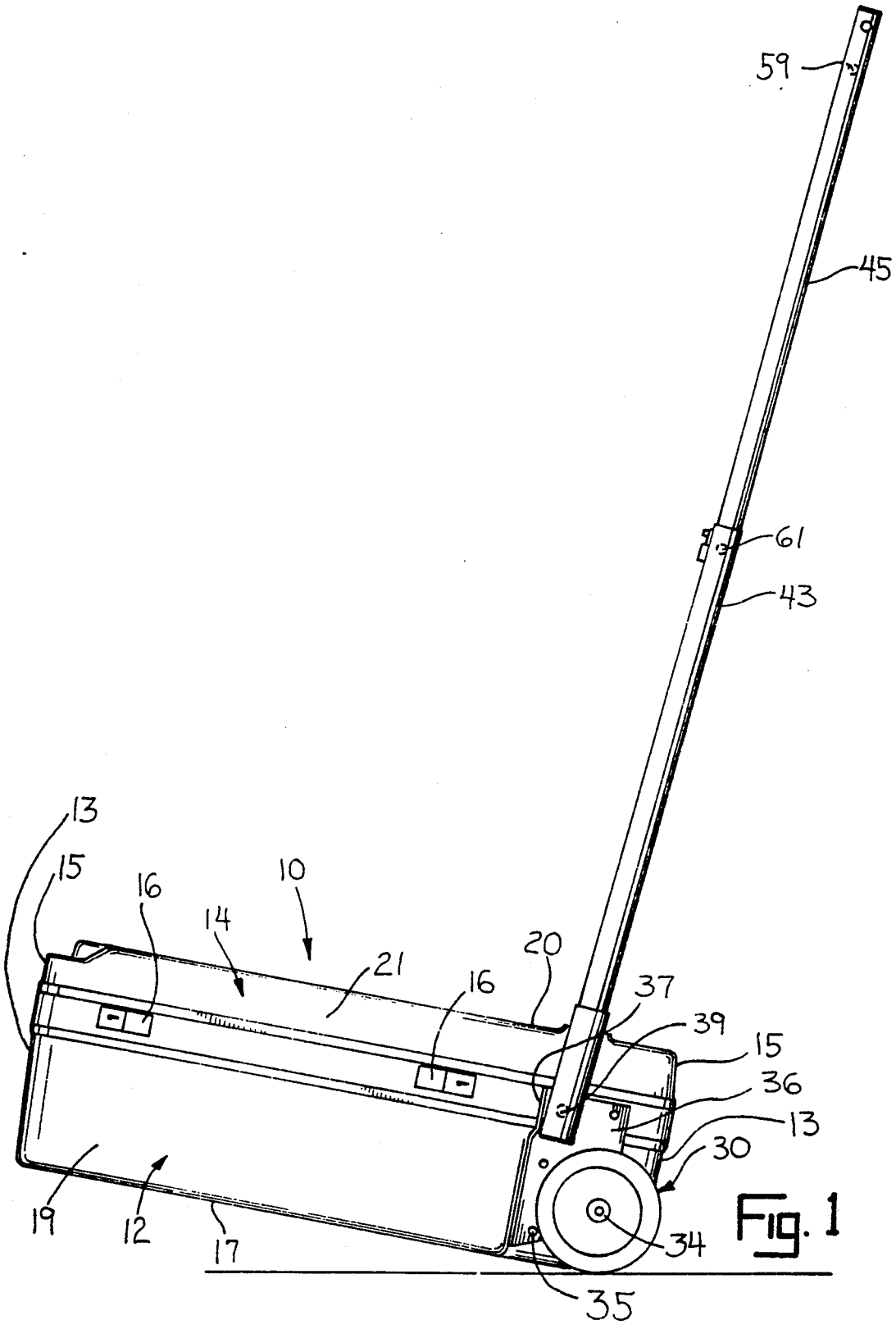
FIG. 1 is a perspective view of the carry-on case of this invention having a built-in travel cart with the handle raised and extended positions and tilted about its wheels.

Case 10 is illustrated in FIGS. 1–6 and includes a base 12 and a lid 14 both of which are connected and held together by rear hinges 25. Case 10 also includes two wheels 30 and a handle 40 that is releasably extendable, collapsible, lowerable and raisable.

Figure 2:
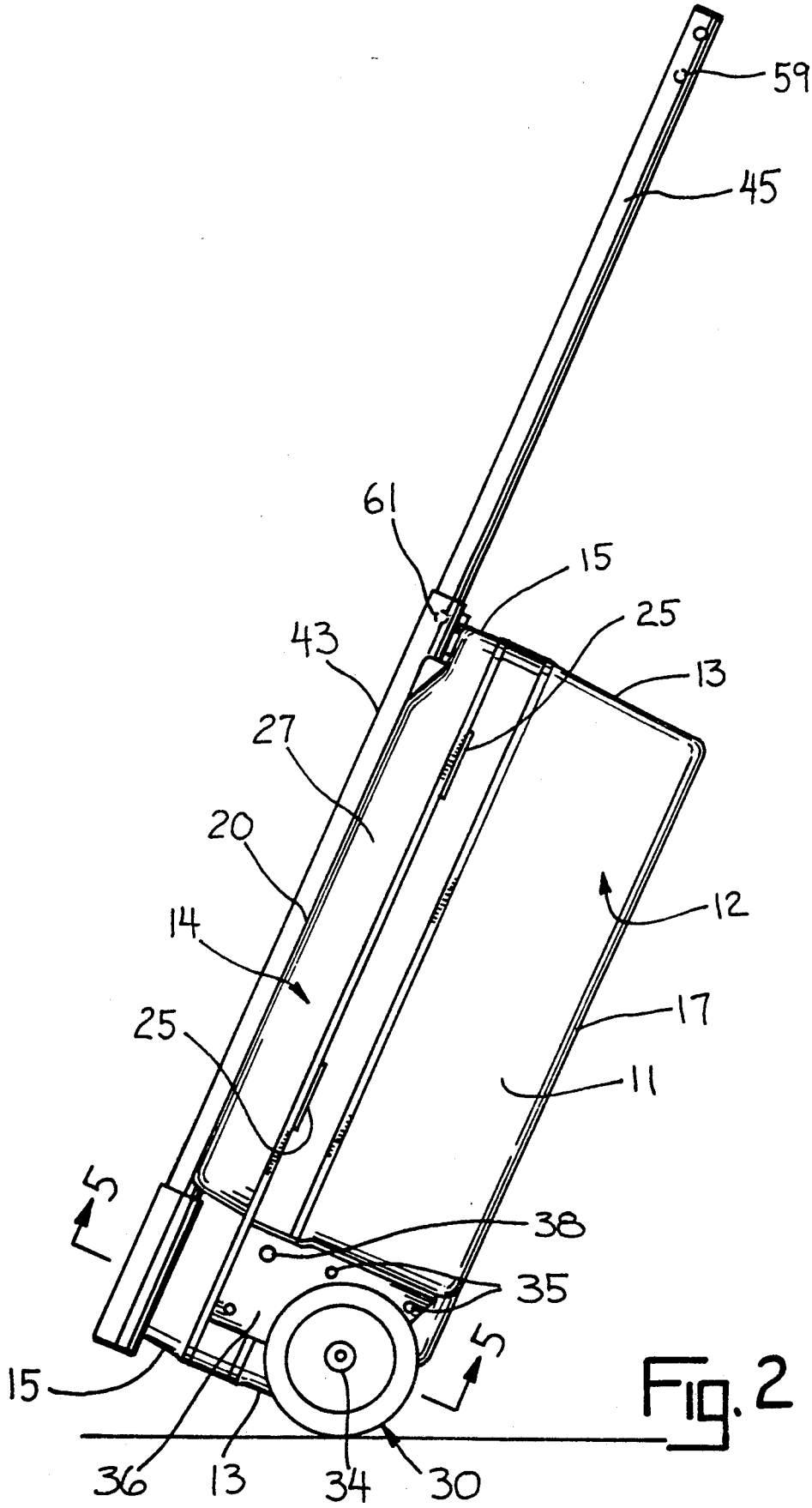
FIG. 2 is a perspective view of the carry-on case of this invention which shows the case in a tilted position about its wheels with the handle in its extended and lowered positions.
Figure 3:
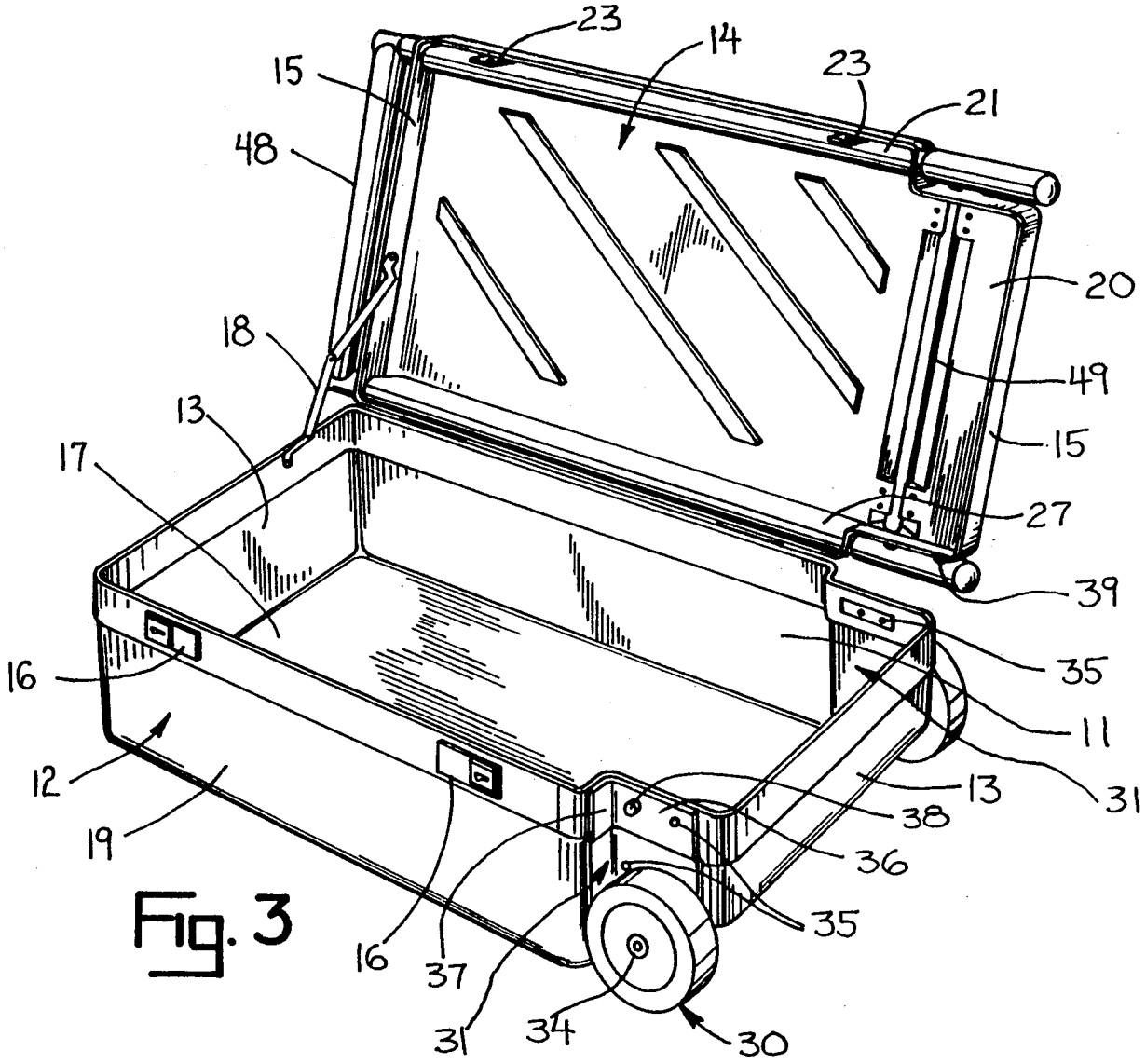
FIG. 3 is an elevational view of the carry-on case with the lid in an open position and with the handle in its lowered and collapsed positions.

Base 12 of case 10 includes a bottom wall 17, two end walls 13, a rear wall and a front wall 19. Front wall 19 carries locks 16. Lid 14 is shiftable about hinges 25 from an open position as shown in FIG. 3 to a closed position as illustrated in FIGS. 1–2. When in its open position, lid 14 is supported and held open by a hinged lid holder 18. Lid 14 also includes a top wall 20, two end walls 15, a rear wall 27 and a front wall 21. Front wall 21 includes latches 23 which interlock with locks 16 to secure lid 14 in a closed position over base 12.

Wheels 30 are positioned on opposite sides of base 12 in indentations 31 formed in each wall 11 and 19. Wheels 30 are journalled upon an axle member 32 which extends along the bottom wall 17 of base 12. Axle member 32 extends through each wheel at its center with the wheels being retained upon the axle member by press-fitted retainer cups 34. Axle member 32 is secured to base 12 by extending through wheel plates 36. Wheel plates 36 are secured to base walls 11 and 19 within indentations 31 by fasteners 35.

Handle 40 of case 10 is releasably extendable, collapsible, lowerable and raisable as shown in FIGS. 1–6. Handle 40 includes two parallel side rails. Each side rail includes an outer telescopic member 43 and an inner telescopic member 45. Outer telescopic members 43 are joined at corresponding ends by a cross brace 50 and at their opposite corresponding ends by a pivot rod 44.

Figure 4:
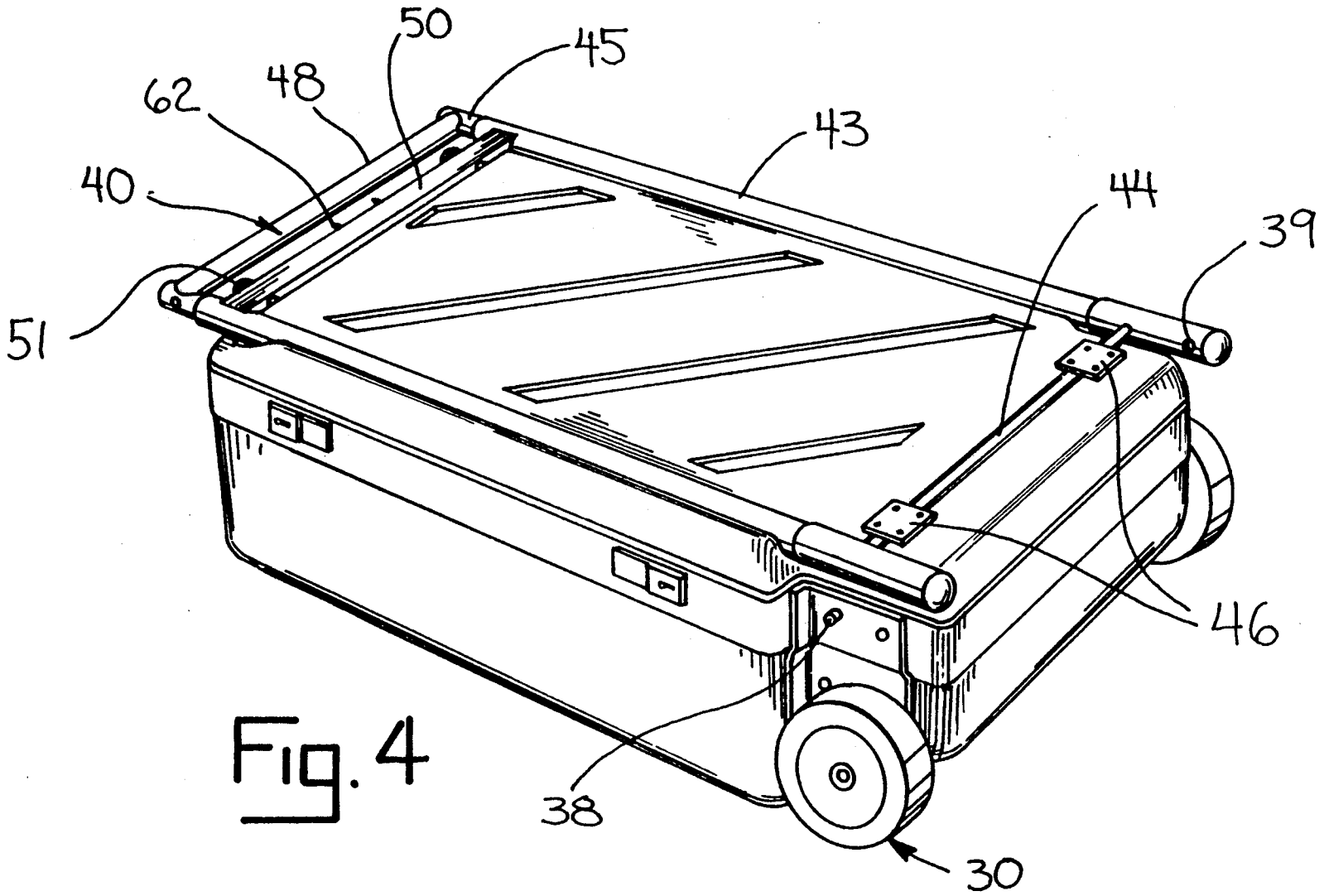
FIG. 4 is an elevational view of the carry-on case with the lid in a closed position and with the handle in its lowered and collapsed positions.
Figure 8:
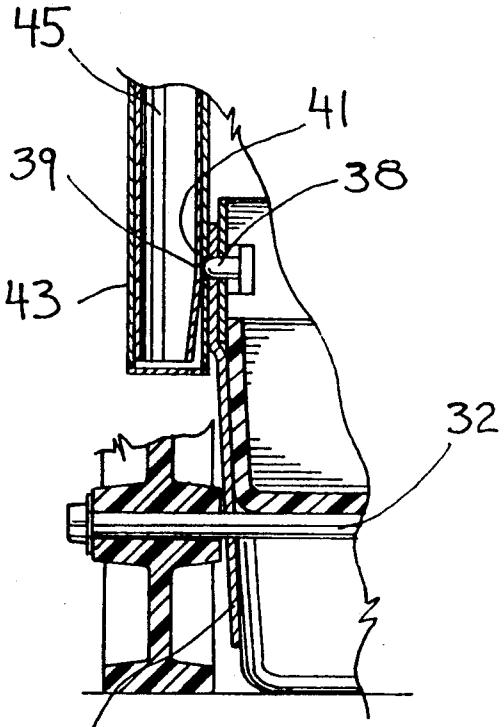
FIG. 8 is a fragmentary sectional view of the handle shown in its raised and collapsed positions.

Pivot rod 44 as shown in FIGS. 3–4 is retained in a transverse channel 49 formed in lid 14 by hold down plates 46 which are attached to lid 14 by rivets or other suitable fastening means. Pivot rod 44 is rotatable about its axis within channel 49 to permit handle 40 to be moved from the lowered position shown in FIG. 4 to a raised position when the lid 14 is closed as shown in FIGS. 1–2. When in its raised position, the handle preferably abuts outturned flange 37 of each plate 36 in an over-center orientation. A spring biased pin 38 extends into an opening 39 at the pivoted end of each outer telescopic member 43 to secure the handle in its raised position. To lower handle 40, the inner telescopic members 45 are first collapsed to cause bevelled end 41 of each inner telescopic member 45 to engage the protruding pin 38 and cam the pin sufficiently out of opening 39 in the outer telescopic member 43 to allow pivotal movement of the handle.

A hand grip 48 is connected to inner telescopic members 45 of handle 40 at their free ends. The inner telescopic members 45 are shiftable relative to the outer telescopic members 43 to allow handle 40 to assume the collapsed position seen in FIGS. 3 and 4 and the extended position seen in FIGS. 1 and 2. The extension of the handle is accomplished by pulling out on hand grip 48.

Handle 40 is selectively secured in its collapsed position or extended position by means of a locking system which is housed in and carried by cross brace 50. This locking system includes two lock rods 58 which are oppositely extending and are axially aligned. Lock rods 58 are retained within cross brace 50 and protrude through guide holes 57 formed in the inside of outer telescopic members 43 and aligned lock holes 59 in the inner telescopic members 45. Each of the lock rods 58 can be retracted out of the lock holes 59 to permit the inner telescopic members 45 to shift relative to the outer telescopic members 43. This feature permits either extension or retraction of handle 40.

Lock rods 58 are normally urged outwardly to a protruding position relative to lock holes 59 by a helical spring 60. Each end of helical spring 60 extends about an inner end of a lock rod 58, abutted compressively against a transverse grip pin 62. Each grip pin 62 is press-fitted through a lock rod 58. The grip pins 62 extend outwardly through the cross brace 50 to an exposed position that is adjacent to hand grip 48 when the handle 40 is in its collapsed position. Shifting or squeezing together the exposed ends of grip pins 62 compresses helical spring 60 and draws lock rods 58 together to cause the outer ends of lock rods 58 to be withdrawn from lock holes 59 of the inner telescopic members 45, freeing handle 40 and permitting it to be extended.

To secure handle 40 in its extended position, the inner telescopic members 45 have formed at their opposite ends a second set of lock holes 61. As the inner telescopic members 45 are shifted and releasably extended, the lock rods 58 align with the lock holes 61 in inner telescopic members 45 to permit each of the lock rods 58 to be again urged by helical spring 60 into the inner lock holes to secure the handle 40 in its extended position as is shown in FIGS. 1–2.

Again, to release and collapse handle 40, the case user need only squeeze together with one hand transverse grip pins 62. This causes the lock rods 58 to be withdrawn from the lock holes 61 and allows the inner telescopic members 45 to be pushed into outer telescopic members 43 until rods 58 enter lock holes 59.

In its lowered and collapsed position as shown in FIGS. 3–4, it is necessary to secure handle 40 to case 10. This is accomplished by another locking system including two lock pins 52 which are retained by cross brace 50 and which include head parts 51 and shank parts 53. The head parts 51 extend outwardly from the cross brace 50 and rest against cross brace 50 next to hand grip 48. Each shank part 53 protrudes interiorally through openings in cross brace 50. A head part 51 located exteriorly of the cross brace is threaded onto one end of the shank part. The opposite end of the shank part protrudes outwardly from brace 50. A helical spring 54 extends about each lock pin shank part 53 and is compressed between brace 50 and a shoulder 63 on the shank part so as to urge the lock pin shank part toward a strike plate 56 attached to lid end wall 15 with head part 51 abutting the brace. The protruding end of each shank 53 is forced by spring 54 into a lock hole 55 in strike plate 56 to secure the handle in its lowered position.

To release handle 40 from its lowered position in order to allow the handle to pivot away from case 10 into its raised position, the user need only grasp the head parts 51 of lock pins 52 and pull. This causes the helical springs 54 to be compressed with the shanks 53 being withdrawn from the lock holes 55 in the strike plates 56.

Figure 5:
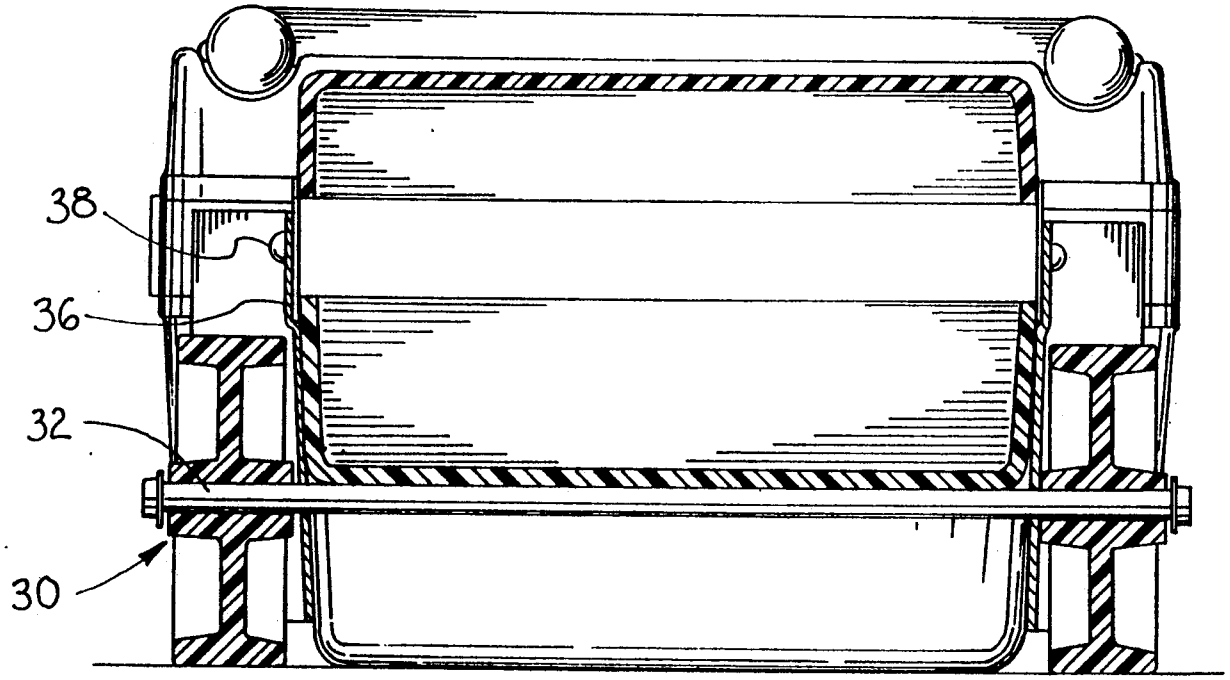
FIG. 5 is a sectional view seen along line 5—5 of FIG. 2.
Figure 7:
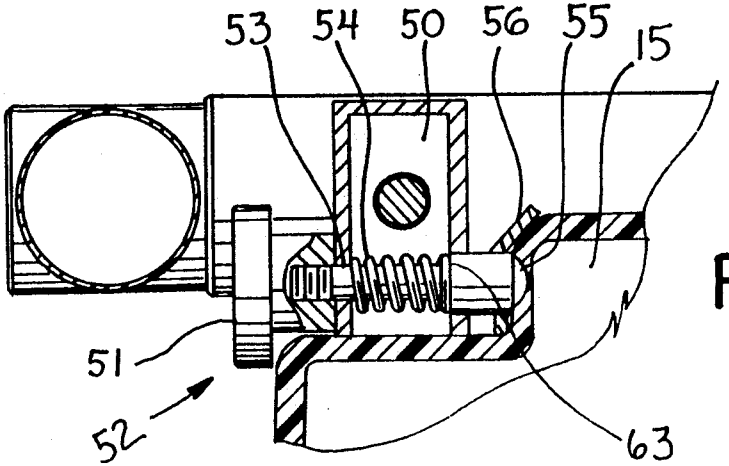
FIG. 7 is a fragmentary sectional view seen along line 7—7 of FIG. 6.
Figure 6:
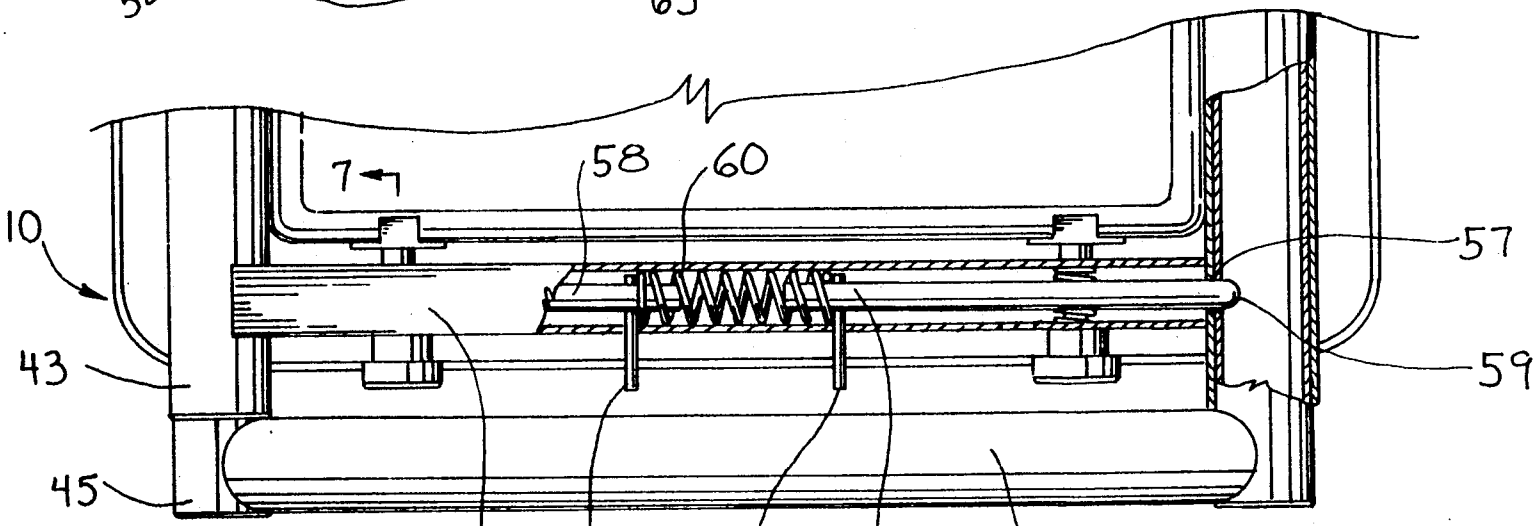
FIG. 6 is a fragmentary sectional view with positions removed to illustrate the securing and locking features of the handle.

When handle 40 is moved into its extended and raised position shown in FIG. 1, luggage composed of from 4 to 5 suitcases can be stacked upon the closed lid 14 and can rest against raised and extended handle 40. FIG. 2 illustrates a second towable orientation in which handle 40 is extended in its lowered position. In this position the case 10 can be pivoted upwards to permit towing. FIGS. 3–5 illustrate case 10 with handle 40 in its lowered and collapsed positions with handle 40 being usable as a grip to carry the case. Sufficient spacing is provided between grip 48 and brace 50 to allow the grip to be grasped by the hand of the user.

It is understood that the above description does not limit the invention to those details, which may be modified within the scope of the following claims.

I claim:

1. A carry case comprising a base and a lid, a hinge member pivotally connecting said lid to the base, said lid being shiftable between an open position exposing the interior of said base and a closed position overlying the base, means for releasably securing said lid to the base in its said closed position, wheels carried by said base adjacent one end of the base, handle means pivotally carried by said lid and being shiftable between a lowered position overlying the lid and a raised position extending upwardly from the lid, said handle means for tilting said base with said lid in its closed position upwardly about said wheels when the handle means is in its raised position, said lid forming means for supporting articles thereon when the lid is in its closed position and said handle means is in its raised position, said handle means including extendable parts for causing the handle means to have either a collapsed position or an extended position when in its lowered position, means for releasably securing said handle means in its lowered position, said handle means for tilting said base with said lid in its closed position upwardly about said wheels when the handle means is in its extended position and secured in its lowered position.

2. The case of claim 1 wherein said handle means is pivotally carried by said lid at a location over the rotative axis of said wheels.

3. The case of claim 1 and means for releasably securing said handle means in its raised position.

4. The case of claim 3 and means for releasably securing said handle means in its extended position.

5. The case of claim 4 and means for releasably securing said handle means in its collapsed position.

* * * * *